US006334577B1

(12) United States Patent
Chih

(10) Patent No.: US 6,334,577 B1
(45) Date of Patent: Jan. 1, 2002

(54) DUAL AXIS OSCILLATING SPRINKLER WITH A CRANK DRIVE

(76) Inventor: I-Shun Chih, No. 5, Tyan Yang Lane, Lu Kang Chen, Chang Hua County (TW)

( * ) Notice: Subject to any disclaimer, the term of this patent is extended or adjusted under 35 U.S.C. 154(b) by 0 days.

(21) Appl. No.: 09/484,037

(22) Filed: Jan. 18, 2000

Related U.S. Application Data

(63) Continuation-in-part of application No. 08/804,842, filed on Feb. 24, 1997, now abandoned.

(30) Foreign Application Priority Data

Apr. 23, 1996 (TW) ..... 85205975

(51) Int. Cl.[7] ..... B05B 3/16
(52) U.S. Cl. ..... 239/242; 239/244

(58) Field of Search ..... 239/225.1, 237, 239/240, 241, 242, 243, 244, 263.3, 264

(56) References Cited

U.S. PATENT DOCUMENTS

| | | | | |
|---|---|---|---|---|
| 480,047 | A | 8/1892 | Steitz | 239/244 X |
| 1,719,790 | A | 7/1929 | Van Aken | 239/243 |
| 2,943,796 | A | 7/1960 | Smith | 239/244 |

*Primary Examiner*—Lesley D. Morris
(74) *Attorney, Agent, or Firm*—Bacon & Thomas

(57) ABSTRACT

A double rocking sprinkler has a first casting, a second casing coupled with the first casing, a first cover and a second cover covering the first and the second casings, and a first sprinkle plate and a second sprinkle plate disposed in the sprinkler in series. A drive device is disposed in the sprinkler for rotating the first and second sprinkle plates relative to each other.

6 Claims, 6 Drawing Sheets

DUAL AXIS OSCILLATING SPRINKLER WITH A CRANK DRIVE

CROSS-REFERENCE TO RELATED APPLICATIONS

This application is a continuation-in-part of application Ser. No. 08/804,842, filed on Feb. 24, 1997, now abandoned, which is hereby incorporated by reference into the present application.

BACKGROUND OF THE INVENTION

The present invention generally relates to sprinklers, and, more particularly, to double rocking sprinklers.

SUMMARY OF THE INVENTION

An object of the invention is to provide a rocking sprinkler which can sprinkle water over a large area. In one embodiment, the sprinkler includes a first casing, a second casing coupled with the first casing, and first and second covers covering the first and the second casings. A first sprinkle plate and a second sprinkle plate are then disposed in series with a drive device for driving the first and the second sprinkle plates.

A motion converter is connected to a joint connection with the drive device. A gear seat is coupled with the motion converter and a hollow sleeve is inserted in the gear seat with an elastic element disposed between the hollow sleeve and the gear seat. A manual adjusting pin is also coupled with the motion converter.

The first cover has a first hole for receiving water and the second cover has a second hole. The first sprinkle plate is positioned in the first casing with a plurality of first spout holes for dispersing water while the second sprinkle plate is positioned in the second casing with a plurality of second spout holes, also for dispersing water. A driven plate is then connected to the first sprinkle plate.

The drive device includes a first adapter connected to the joint and a second adapter connected to the second sprinkle plate. The drive device has a first hollow housing, a second hollow housing coupled with the first hollow housing, and a fixing seat positioned in the first hollow housing. A vane type wheel is coupled with the fixing seat so that a hollow disk receives the vane type wheel. A gear set is then disposed between the hollow disk and the second hollow housing.

The second hollow housing has a positioning hole on which a crank arm is disposed. The crank arm has an inserted hole and a pivot rod is disposed on the crank arm. The vane type wheel has a pinion disposed thereon and a plurality of periphery vanes. The hollow disk has a center hole and the gear seat. The gear set then has a first shaft, a second shaft, a coupler, a first gear, a second gear, and a third gear. A gear wheel is also disposed on the coupler.

A rear portion of the coupler passes through the positioning hole and the inserted hole to engage with the crank arm. The first shaft pivotally fastens the first gear and the second gear on the gear seat. The second gear engages with the pinion. The second shaft then pivotally fastens the coupler, the third gear and the pinion while the gear wheel engages with the first gear. A link rod links the driven plate and the pivot rod.

The invention also relates to a dual rocker sprinkler including a first sprinkle plate, a second sprinkle plate arranged substantially parallel to the first sprinkle plate, first means for rotating the first and second sprinkle plates about a first axis, and second means for rotating the first and second sprinkle plates about axes which are substantially perpendicular to the first axis. The first means may include a motion converter and the second means may include a drive device. The first and second sprinkle plates may also be tangentially engaged with each other at one end while the drive may include a crank arm linked to one of said first and second sprinkle plates for reciprocatingly rotating the one plate. The sprinkler may further include a driven plate fixed to said one sprinkle plate at one end, and a link rod rotatably secured at a first end to another end of said driven plate and rotatably secured to said crank arm at a second end.

DETAILED DESCRIPTION OF THE PREFERRED EMBODIMENTS

Figure 1:
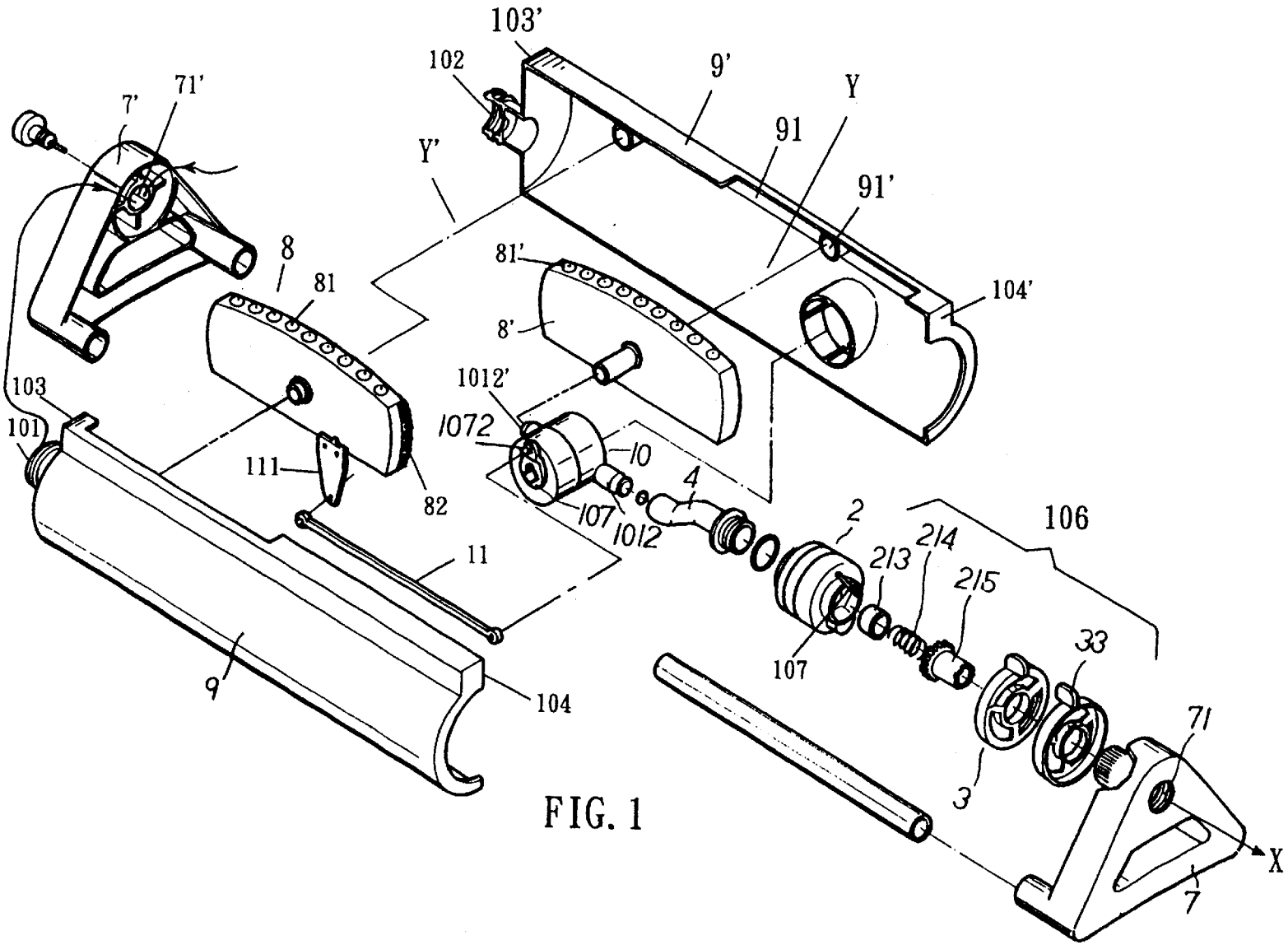
FIG. 1 is an exploded perspective view of a sprinkler in accordance with the present invention.
Figure 1B:
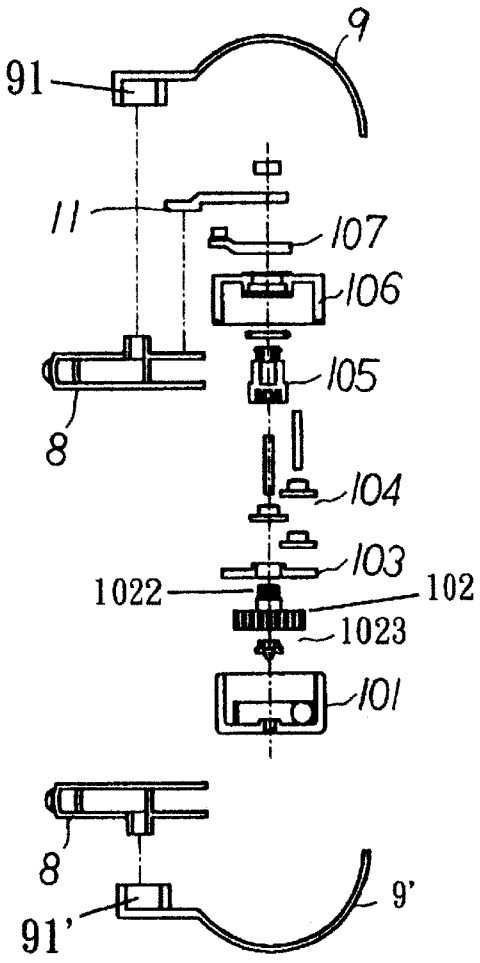
FIGS. 1A and 1B are exploded side views of the sprinkler shown in FIG. 1.
Figure 1A:
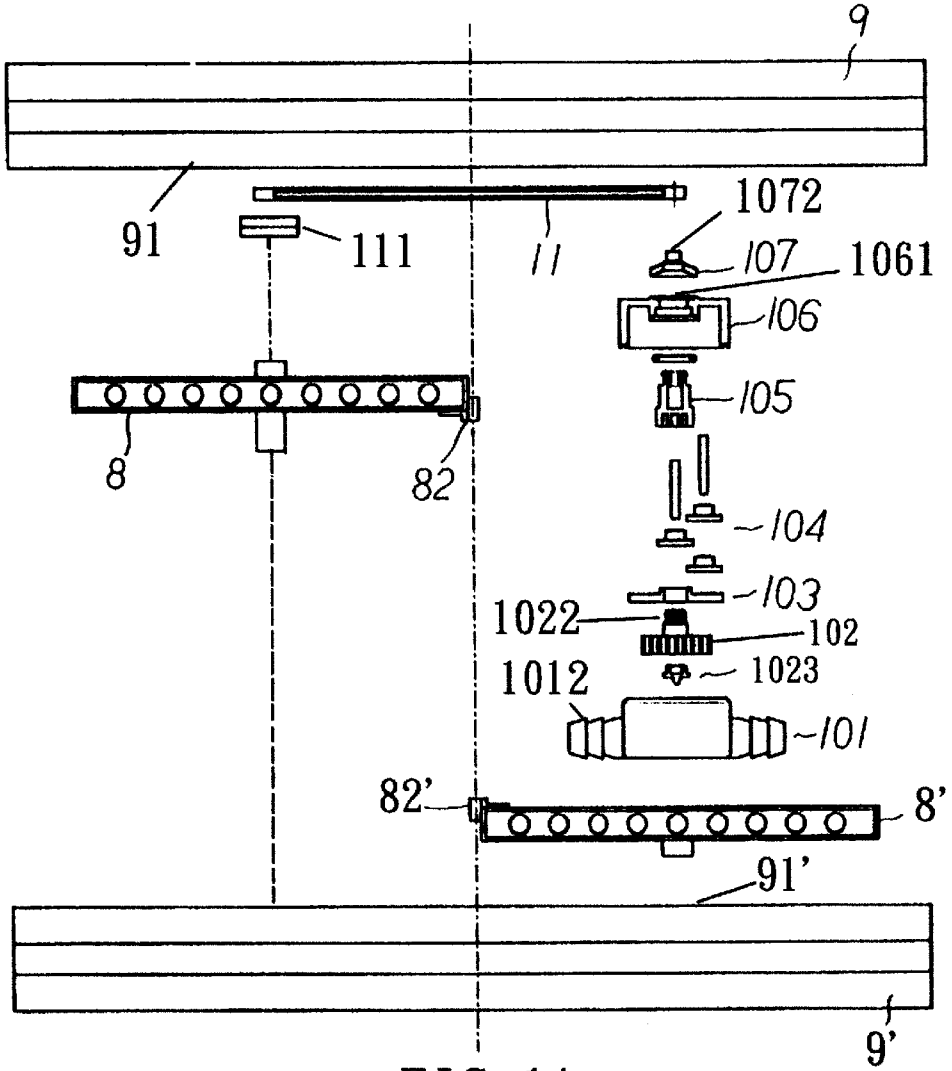
Figure 2:
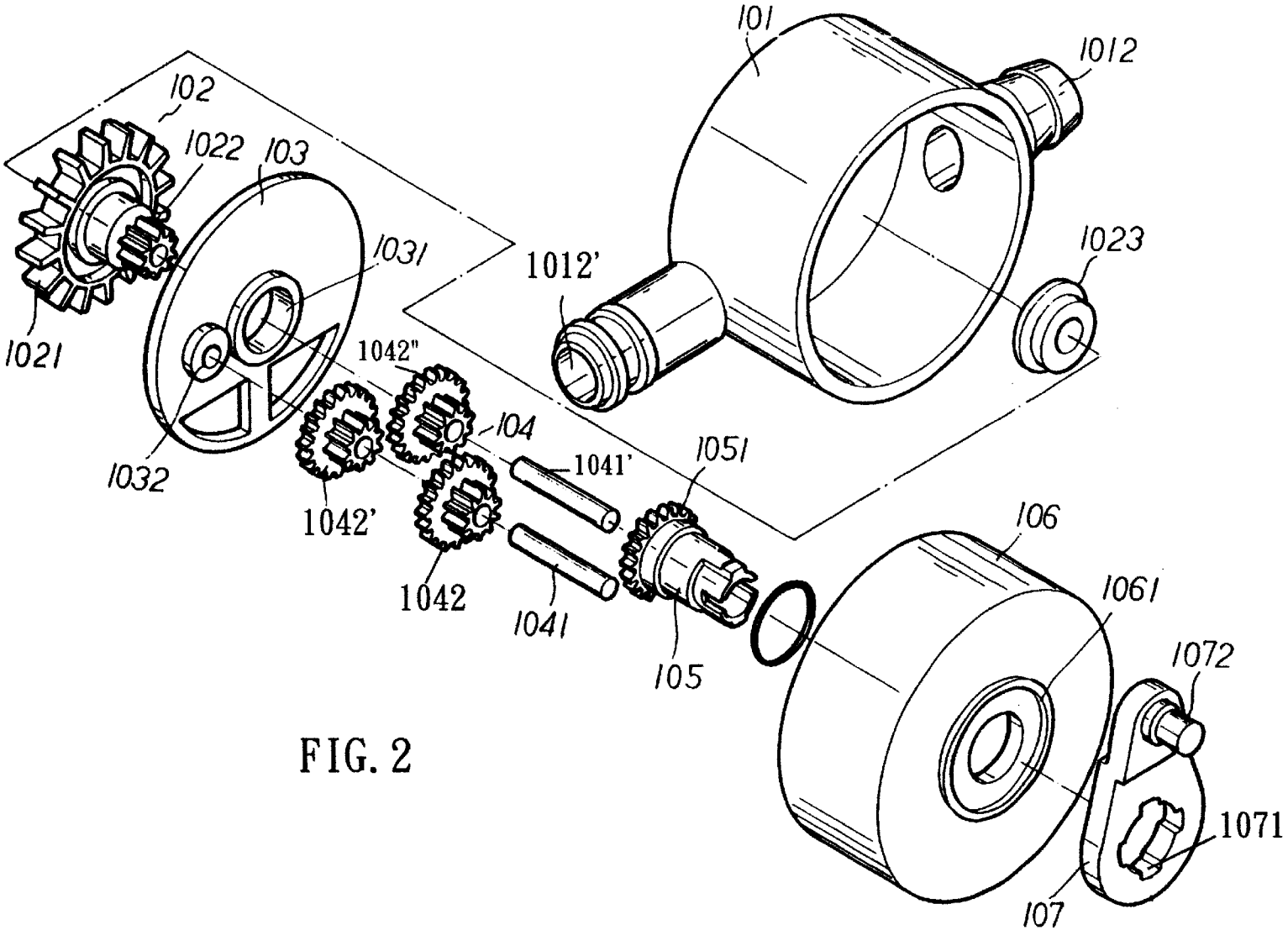
FIG. 2 is an exploded perspective view of a drive device.
Figure 4:
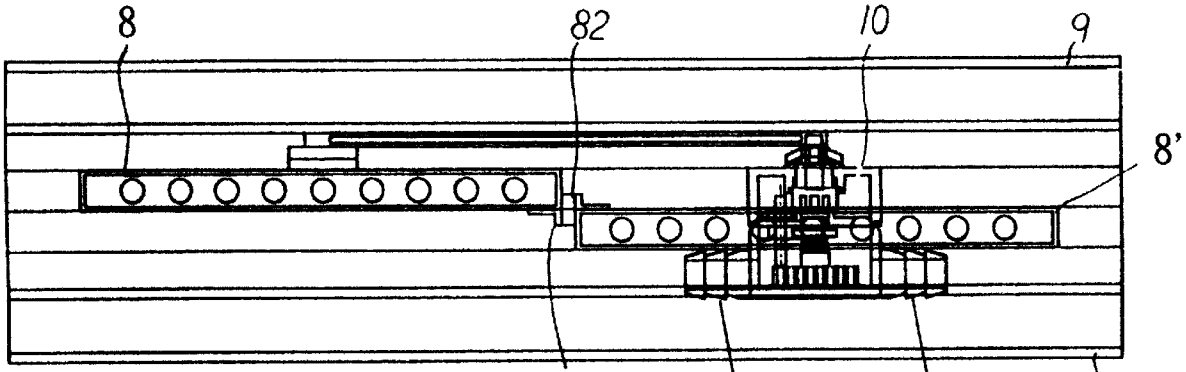
FIGS. 4 and 5 are partial plan and partial sectional views of the sprinkler shown in FIG. 1.
Figure 3:
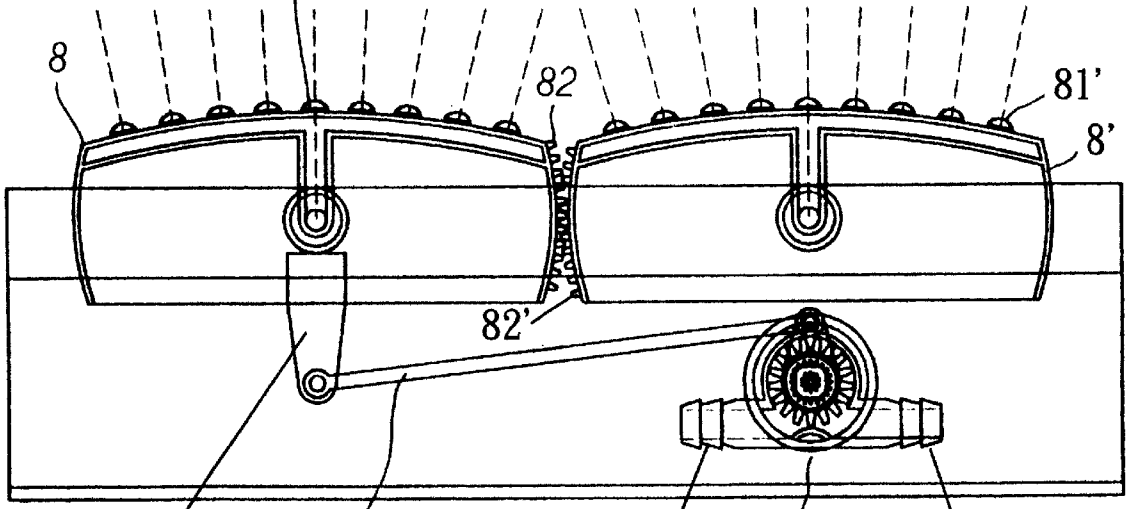
FIGS. 3, 3A and 3B are partial sectional views of the sprinkler shown in FIG. 1.
Figure 5:
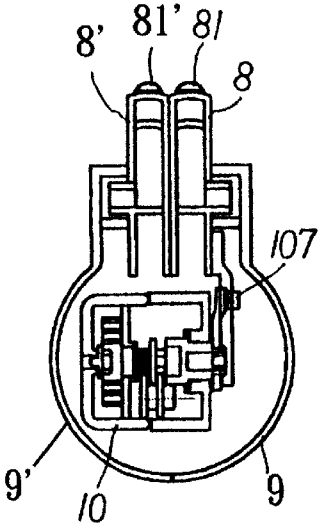
Figure 3A:
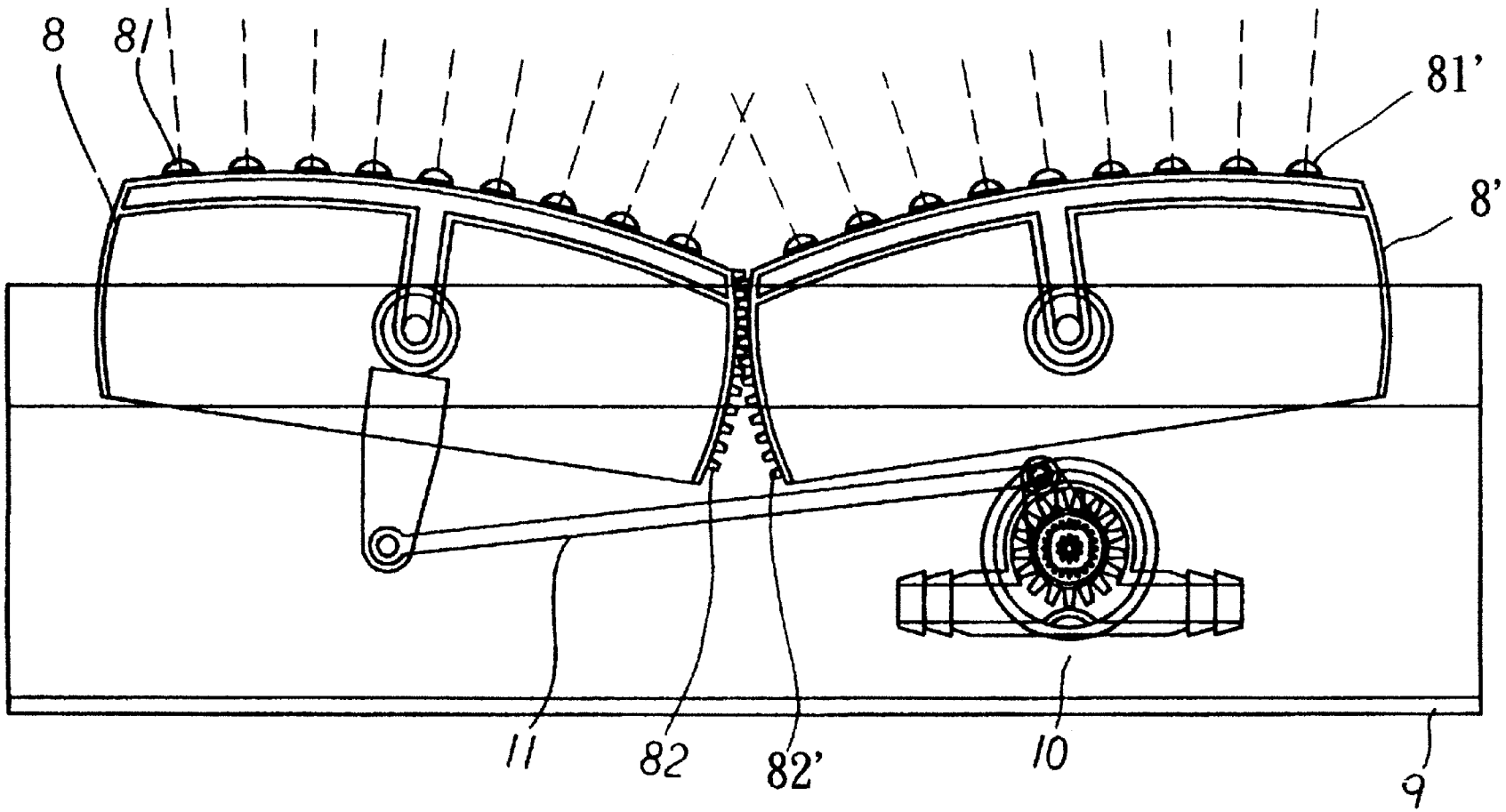
Figure 3B:
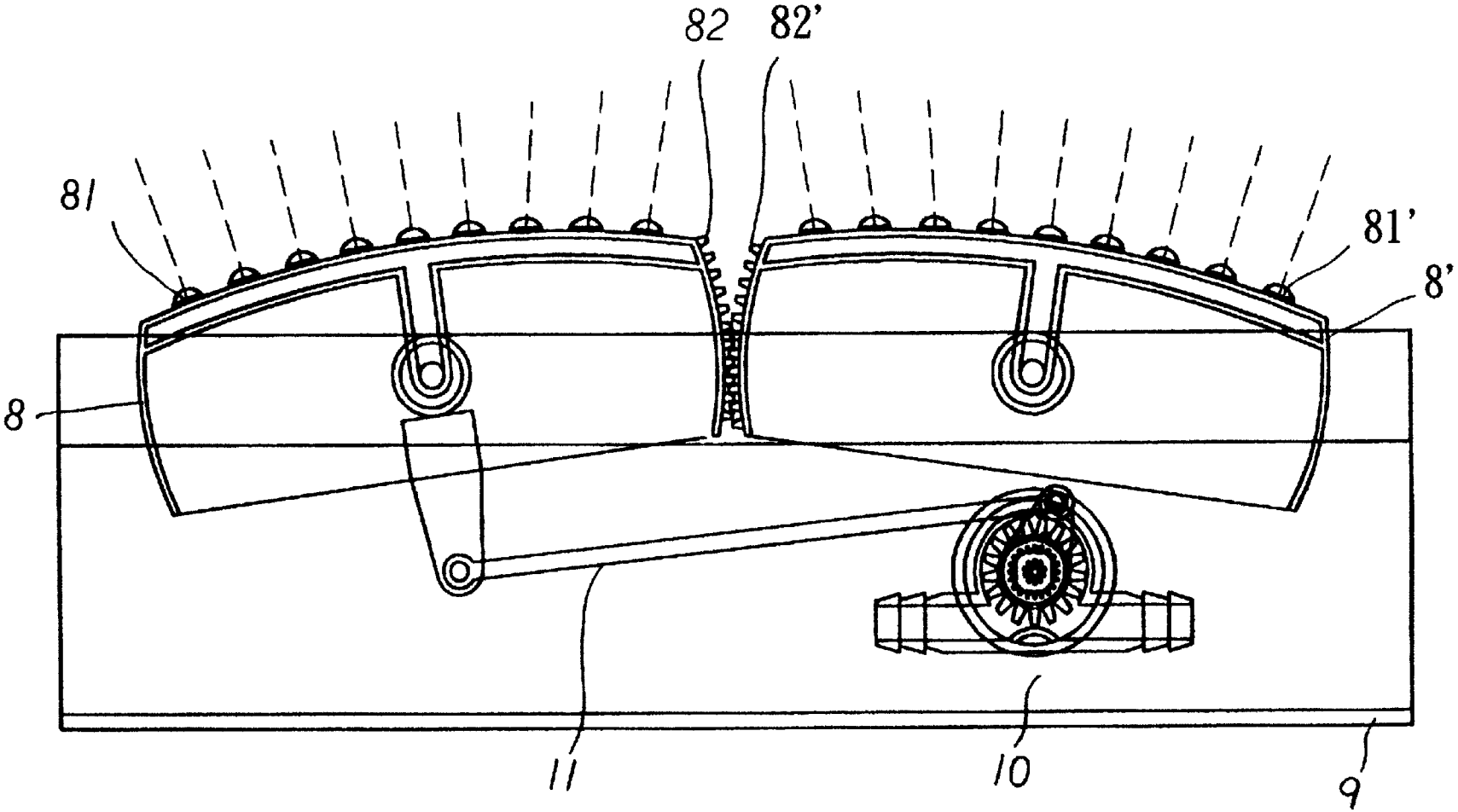

Referring to FIGS. 1 to 5, a sprinkler has a first casing 9, a second casing 9' coupled with the first casing 9, a first cover 7 and a second cover 7' covering the first and the second casings 9, 9', a first sprinkle plate 8 and a second sprinkle plate 8' disposed in the sprinkler in series, a drive device 10 disposed in the sprinkler to drive the first and the second sprinkle plates 8, 8', a joint 4 connected to the drive device 10, a motion converter 2 connected to the joint 4, a gear seat 215 coupled with the motion converter 2, a hollow sleeve 213 inserted in the gear seat 215, an elastic element 214 disposed between the hollow sleeve 213 and the gear seat 215, and a manual adjusting pin 3 coupled with the motion converter 2.

The first cover 7 has a first hole 71. The second cover 7' has a second hole 71'. The first sprinkle plate 8 has a plurality of first spout holes 81. The first sprinkle plate 8 is positioned in the first casing 9. The second sprinkle plate 8' has a plurality of second spout holes 81'. The second sprinkle plate 8' is positioned in the second casing 9'. The first sprinkle plate 8 includes a plurality of teeth 82 which mesh with corresponding teeth 82' on second sprinkle plate 8' so as to tangentially engage the sprinkle plates for a reciprocating rocking motion shown in FIGS. 3-A and 3-B. A driven plate 111 is connected to the first sprinkle plate 8.

The drive device 10 comprises a first adapter 1012 connected to the joint 4 and a second adapter 1012' connected to the nipple on the second sprinkle plate 8' by a connection means, such as a conduit or tube (not shown). The second sprinkle plate 8' is also connected to the inlet of a conduit 91' running inside the second casing 9'. The first sprinkle plate 8 is then fluidly connected to the outlet of the conduit 91', such as by using another conduit 91 or flexible hose (not shown).

The drive device 10 has a first hollow housing 101, a second hollow housing 106 coupled with the first hollow housing 101, a fixing seat 1023 positioned in the first hollow housing 101, a vane type wheel 102 coupled with the fixing seat 1023, a hollow disk 103 receiving the vane type wheel 102, and a gear set 104 disposed between the hollow disk 103 and the second hollow housing 106. The second hollow housing 106 has a positioning hole 1061.

A crank arm 107 is disposed on the second hollow housing 106. The crank arm 107 has an inserted hole 1061. A pivot rod 1072 is disposed on the crank arm 107. The vane type wheel 102 has a plurality of periphery vanes 1021. A pinion 1022 is disposed on the vane type wheel 102. The hollow disk 103 has a center hole 1031 and a gear seat 1032.

The gear set 104 has a first shaft 1041, a second shaft 1041', a coupler 105, a first gear 1042, a second gear 1042', and a third gear 1042". A gear wheel 1051 is disposed on the coupler 105. A roar portion of the coupler 105 passes through the positioning hole 1061 and the inserted hole 1071 to engage with the crank arm 107. The first shaft 1041 fastens the first gear 1042 and the second gear 1042' on the gear seat 1012 pivotally. The second gear 1042' engages with the pinion 1022. The second shaft 1041' fastens the coupler 105, the third gear 1042" and the pinion 1022 pivotally. The gear wheel 1051 engages with the first gear 1042. A link rod 11 links the driven plate 111 and the pivot rod 1072.

When water flows from the joint 4 into the drive device 10, the vane type wheel 102 is rotated. The gear set 104 is driven to rotate by the vane type wheel 102. The gear wheel 1051 is rotated to drive the crank arm 107 to rotate. The crank arm 107 drives the link rod 11 to rock. The link rod 11 will drive the first sprinkle plate 8 and the second sprinkle plate 8 to rock.

Water flows through the hole 71 to the motion converter 2, which causes the first and second sprinkle plates 8, 8' to rock, or oscillate, about a first axis, X. The flow of water continues through drive device 10 which, with the aid of link rod 11, causes sprinkle plates 8, 8' to oscillate about a second axis, Y, which is substantially perpendicular to the first axis. The water then flows out of the second adapter 1012' through a conduit (not shown) to the second sprinkle plate 8' and then through the conduit 91' in the second casing 9' to the first sprinkle plate 8.

The invention is not limited to the above embodiment but various modification thereof may be made. Further, various changes in form and detail may be made without departing from the scope of the invention.

What is claimed is:

1. A dual rocker sprinkler, comprising:

a first casing, a second casing coupled with the first casing to form a casing unit, a first cover and a second cover covering the first and the second casings, a first sprinkle plate and a second sprinkle plate disposed in the sprinkler in series, a drive device disposed in the sprinkler to drive the first and the second sprinkle plates, a joint connected to the drive device, a motion converter connected to the joint and arranged to cause oscillation of said casing unit about a first axis relative to said first and second covers, a gear seat coupled with the motion converter, a hollow sleeve inserted in the gear seat, an elastic element disposed between the hollow sleeve and the gear seat, and a manual adjusting pin coupled with the motion converter, the first cover having a first hole for receiving water, the second cover having a second hole, the first sprinkle plate having a plurality of first spout holes for dispersing the water, the first sprinkle plate positioned in the first casing and mounted for rotation about a second axis transverse to said first axis, the second sprinkle plate having a plurality of second spout holes for dispersing the water, the second sprinkle plate positioned in the second casing and mounted for rotation about a second axis parallel to said second axis, a driven plate connected to the first sprinkle plate, the drive device comprises a first adapter connected to the joint and second adapter connected to the second sprinkle plate, the drive device having a first hollow housing, a second hollow housing coupled with the first hollow housing, a fixing seat positioned in the first hollow housing, a vane wheel, coupled with the fixing seat, a hollow disk receiving the vane wheel, and a gear set disposed between the hollow disk and the second hollow housing, the second hollow housing having a positioning hole, a crank arm disposed on the second hollow housing, the crank arm having an inserted hole, a pivot rod disposed on the crank arm, the vane wheel having a plurality of periphery vanes, a pinion disposed on the vane wheel, the hollow disk having a center hole and the gear seat, the gear seat having a first shaft, a second shaft, a coupler, a first gear, a second gear, and a third gear, a gear wheel disposed on the coupler, a rear portion of the coupler passing through the positioning hole and the inserted hole to engage with the crank arm, the first shaft fastening the first gear and the second gear on the gear seat pivotally, the second gear engaging with the pinion, the second shaft fastening the coupler, the third gear and the pinion pivotally, the gear wheel engaging with the first gear, and a link rod linking the driven plate and the pivot rod.

2. A dual rocker sprinkler, comprising:

a first sprinkle plate;

a second sprinkle plate arranged substantially parallel to the first sprinkle plate;

first means for rotating the first and second sprinkle plates about a first axis; and second means for rotating the first and second sprinkle plates about axes which are substantially perpendicular to the first axis.

3. The double rocker sprinkler recited in claim 2 wherein the first means includes a motion converter.

4. The double rocker sprinkler recited in claim 2 wherein said second means includes a drive device.

5. The double rocker sprinkle recited in claim 4 wherein said first and second sprinkle plates are tangentially engaged with each other at one end and said drive device includes a crank arm linked to one of said first and second sprinkle plates for reciprocatingly rotating the one of said first and second sprinkle plates.

6. The double rocker sprinkler recited in claim 5 further comprising:

a driven plate fixed to said one sprinkle plate at one end; and a link rod rotatably secured at a first end to another end of said driven plate and rotatably secured to said crank arm at a second end.

* * * * *